US007737764B2

(12) United States Patent
Mayerl et al.

(10) Patent No.: US 7,737,764 B2
(45) Date of Patent: Jun. 15, 2010

(54) CIRCUIT ARRANGEMENT HAVING A CHANGEOVER APPARATUS AND METHOD FOR OPERATING A CIRCUIT ARRANGEMENT

(75) Inventors: Christoph Mayerl, Munich (DE); Gerhard Nebel, Immenstadt (DE)

(73) Assignee: Infineon Technologies AG, Neubiberg (DE)

( * ) Notice: Subject to any disclaimer, the term of this patent is extended or adjusted under 35 U.S.C. 154(b) by 681 days.

(21) Appl. No.: 11/564,063

(22) Filed: Nov. 28, 2006

(65) Prior Publication Data

US 2008/0024109 A1 Jan. 31, 2008

(30) Foreign Application Priority Data

Jul. 28, 2006 (DE) ..... 10 2006 035 075

(51) Int. Cl.
*G11C 5/14* (2006.01)
*H02M 3/156* (2006.01)
*G05F 1/613* (2006.01)

(52) U.S. Cl. ..... 327/530; 327/541; 323/351

(58) Field of Classification Search ..... 327/530, 327/541; 323/351

See application file for complete search history.

(56) References Cited

U.S. PATENT DOCUMENTS

| | | | | |
|---|---|---|---|---|
| 3,430,063 | A | 2/1969 | Webb | |
| 3,855,101 | A * | 12/1974 | Wilson | 204/406 |
| 6,020,727 | A | 2/2000 | Bernard et al. | |
| 6,583,607 | B1 | 6/2003 | Marty et al. | |
| 2002/0158683 | A1 | 10/2002 | Berthold | |

FOREIGN PATENT DOCUMENTS

| | | |
|---|---|---|
| DE | 101 16 871 | 11/2002 |
| DE | 101 20 790 | 11/2002 |
| WO | WO-02/082248 | 10/2002 |

* cited by examiner

*Primary Examiner*—Evan Pert
(74) *Attorney, Agent, or Firm*—Dickstein, Shapiro, LLP.

(57) ABSTRACT

A circuit arrangement having a changeover apparatus which provides a first voltage in a first state and a second voltage in a second state in order to operate a circuit, where the changeover apparatus is designed such that when changing over from the first state to the second state the voltage provided for operating the circuit changes from the first voltage to the second voltage linearly with time.

23 Claims, 2 Drawing Sheets

CIRCUIT ARRANGEMENT HAVING A CHANGEOVER APPARATUS AND METHOD FOR OPERATING A CIRCUIT ARRANGEMENT

CROSS-REFERENCE TO RELATED APPLICATIONS

This application claims priority to German Patent Application Serial No. 10 2006 035 075.8, filed Jul. 28, 2006, and which is incorporated herein by reference in its entirely.

FIELD OF THE INVENTION

The invention relates to a circuit arrangement having a changeover apparatus which provides a first voltage in a first state and a second voltage in a second state in order to operate a circuit. The invention also relates to a method for operating a circuit arrangement of this kind.

BACKGROUND OF THE INVENTION

In circuit arrangements designed using CMOS technologies, unwanted leakage currents play an ever greater role which is often no longer negligible. Especially for battery-operated appliances of all kinds, very small standby currents are often required which cannot be observed in more complex digital circuits on account of the leakage currents alone. A very effective measure for reducing the leakage current is to lower the operating voltage in standby mode. Since no further clock pulse is applied in standby mode, associated power losses are not relevant. The reduced voltage must merely be high enough for all the register contents to be maintained.

One simple method of voltage reduction involves connecting a diode between the supply connection of the circuit which is to be operated and the supply voltage connection of the circuit arrangement. For a positive supply voltage VDD, the voltage can be lowered by the diode threshold voltage VTH, for a negative supply voltage VSS, it can be raised by the diode threshold voltage VTH. For reasons of clarity, the text below considers only the case of a positive supply voltage VDD, since a person skilled in the art knows to apply the statements to circuit arrangements with negative supply voltages too. For normal mode with the full supply voltage, the diode is bridged by a switch, for example a PMOS transistor.

When the switch closes, two unwanted effects arise. Both the supply voltage connection and the supply connection at the lowered voltage have capacitances which have been charged to the respective voltage. When the diode is bridged by the switch, a voltage dip occurs in the supply voltage, since the capacitance at the lowered voltage needs to be charged to VDD by VTH. This voltage dip cannot be tolerated by certain circuit components. In addition, charging the capacitance at the lowered voltage results in a large current being briefly drawn in unwanted fashion which needs to be provided by the chip power supply.

One improvement is to connect the gate of the PMOS switching transistor to the supply voltage VDD via a capacitance. The gate connection is then connected to a current source which pulls down the gate voltage at a slower rate upon being turned on, which means that the PMOS switching transistor is not turned on abruptly. This makes it possible to eliminate the voltage dip at the supply voltage VDD. However, a drawback is that the current for charging the capacitance at the lowered voltage is not constant on account of the nonlinearity of the switching transistor, and is also subject to process and temperature fluctuations.

BRIEF DESCRIPTION OF THE DRAWINGS

The invention will be explained in more detail below using exemplary embodiments with reference to drawings, in which.

DETAILED DESCRIPTION OF THE INVENTION

Figure 1:
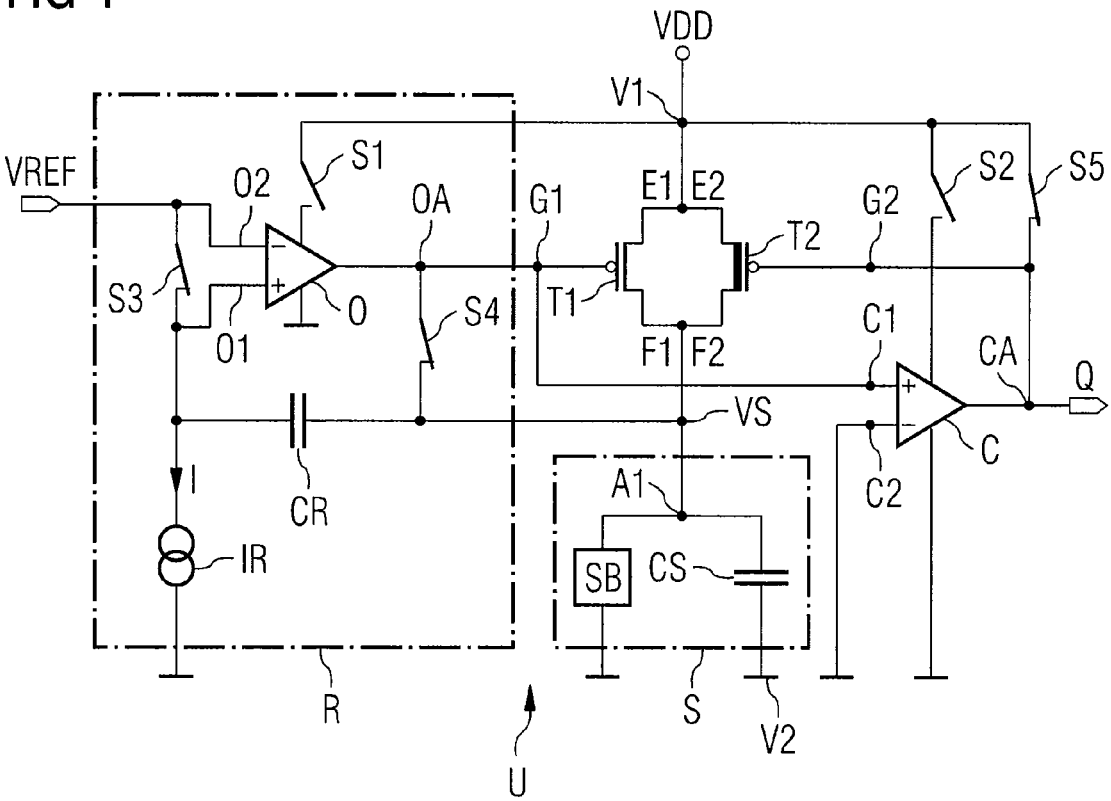
FIG. 1 shows an exemplary embodiment of the inventive circuit arrangement in a first state.

A circuit arrangement having a changeover apparatus providing a first voltage for operating a circuit in a first state and a second voltage for operating the circuit in a second state, wherein a voltage change between the first voltage in the first state and the second voltage in the second state is linear with time. The fact that the voltage for operating the circuit changes from the first voltage to the second voltage linearly with time means that the current for charging the capacitance at the lowered voltage is constant over time. The lowered voltage changes with constant dU/dt until it reaches the supply voltage. The charging current is obtained from CS*dU/dt, CS being the total capacitance of the circuit. Since dU/dt is constant, the charging current is also constant over time, which means that there is neither a voltage dip nor an undesirably large charging current.

A method for operating a circuit in a first state during which the circuit is supplied with a first voltage and in a second state during which the circuit is supplied with a second voltage, wherein a voltage change between the first voltage and the second voltage is linear with time. The linear voltage change avoids voltage dips and undesirably large charging currents.

The changeover apparatus includes a first controllable switch and a second controllable switch connected in parallel between a first connection connected to a first supply voltage connection of the circuit arrangement and a second connection connected to a first supply connection of the circuit which is to be operated. The first and second controllable switches are used to connect the circuit to the supply voltage connection of the circuit arrangement. In this arrangement, the controllable switches may have on-state properties which differ from one another, which means that, depending on which controllable switch is used to supply the circuit with current, different voltages are applied to the supply connection of the circuit which is to be operated.

The first controllable switch and the second controllable switch are transistors.

The control input of the first controllable switch can be connected via a fourth switch to the first supply connection of the circuit which is to be operated. Since the first supply connection of the circuit which is to be operated is connected to the second connection of the first controllable switch, which is in the form of a transistor, said switch can optionally be operated as a diode by closing the fourth switch. The voltage drop between the first connection and the second connection of the first transistor is then determined by the diode threshold voltage, which means that the first transistor can be used to lower the voltage.

The changeover apparatus comprises a regulating circuit for actuating the first controllable switch. Using the regulating circuit, the first controllable switch is actuated with the fourth switch open such that the voltage from the first supply connection of the circuit which is to be operated changes from the first voltage to the second voltage linearly with time. In this case, the second controllable switch needs to be off so that the first controllable switch is not bridged by it, which would mean that regulation were not possible.

The regulating circuit comprises an operational amplifier having a first input, a second input and an output, the output being connected to the control input of the first controllable switch, a capacitor which is connected between the first input of the operational amplifier and the first supply connection of the circuit which is to be operated, a current source which is connected to the first input of the operational amplifier and to a second supply voltage connection of the circuit arrangement, and a reference voltage which is connected to the second input of the operational amplifier. The operational amplifier regulates its output such that the voltage on its first input is the same as the voltage on the second input, that is to say is the same as the reference voltage. Since no current is flowing into the inputs of the operational amplifier, the current flowing through the current source needs to flow through the regulating circuit's capacitor. However, this flow of current has an associated linear voltage increase over time on the capacitor as a result of the capacitor's fundamental equation $I=C*dU/dt$. Since the regulating circuit's capacitor has one of its connections connected to the first input of the operational amplifier and is thus at the reference potential, and has the other connection connected to the first supply connection of the circuit which is to be operated, the voltage for operating the circuit changes linearly with time.

The operational amplifier can be connected via a first switch to the first supply voltage connection of the circuit arrangement. The first switch can be used to supply voltage to the operational amplifier. In standby mode, it is advantageous if the operational amplifier, which is then not needed for regulating, is isolated from the supply potential and deactivated in order to reduce power consumption.

The first input and the second input of the operational amplifier can be connected via a third switch. The third switch can be used to connect the first input and the second input of the operational amplifier to one another, so that the initial conditions can be prescribed for the regulating circuit. When the third switch is open, the operational amplifier can be used for regulating.

The changeover apparatus comprises a voltage monitoring unit for actuating the second controllable switch, the voltage monitoring unit having a first input, a second input and an output. The voltage monitoring unit can be used to ascertain whether a prescribed voltage value is exceeded in the changeover apparatus. The second controllable switch can then be actuated on the basis thereof.

The first input of the voltage monitoring unit is connected to the control input of the first controllable switch, the second input of the voltage monitoring unit is connected to the second supply voltage connection of the circuit arrangement, and the output of the voltage monitoring unit is connected to the control input of the second controllable switch. The voltage monitoring unit is used to compare the voltage on the control input of the first controllable switch with that on the second supply voltage connection of the circuit arrangement. When the charging operation for the circuit's capacitance is almost complete, the first controllable switch is almost driven to the full level, and the voltage applied to its control input is low. This is detected in the voltage monitoring unit, and the second controllable switch is then actuated via the voltage monitoring unit such that it bridges the first controllable switch. In this case, the second controllable switch has a lower on-state resistance than the first controllable switch, which means that, particularly for normal mode, the circuit is supplied via the second controllable switch.

The voltage monitoring unit can be connected via a second switch to the first supply voltage connection of the circuit arrangement. The voltage monitoring unit can be activated and deactivated by means of a switch in the same way as the operational amplifier. In standby mode, the second switch is open, which means that the voltage monitoring unit is deactivated and the circuit arrangement draws less current. In normal mode, the voltage monitoring unit is used to actuate the second controllable switch, which means that the second switch needs to be closed in order to supply the voltage monitoring unit with current.

The control input of the second controllable switch can be connected via a fifth switch to the first supply voltage connection of the circuit arrangement. Closing the fifth switch puts the second controllable switch into an off state, so that the circuit S is supplied only via the first controllable switch. When the circuit is supplied via the second controllable switch, on the other hand, the fifth switch must be open.

In the first state the first and second switches are closed and the third, fourth and fifth switches are open, and in the second state the first and second switches are open and the third, fourth and fifth switches are closed. In the first state, the circuit is in normal mode, the operational amplifier and the voltage monitoring unit are supplied with current via the first and second switches. The third, fourth and fifth switches are open in order to activate the regulating circuit and the second controllable switch. In the second state, the circuit arrangement is in the standby state, the first and second switches are open in order to deactivate the operational amplifier and the voltage monitoring unit. The third switch is closed in order to set the initial conditions for the operational amplifier. The fourth switch is closed in order to connect the first controllable switch as a diode. The fifth switch is closed in order to turn off the second controllable switch.

The first state is a standby state. Standby states are used to reduce power consumption.

The second state is a normal-mode state.

The circuit in the first state is supplied via a first controllable switch.

The first controllable switch is a transistor.

The transistor is connected as a diode in the first state. The fact that the first transistor is connected as a diode means that a diode threshold voltage drops across it. This voltage drop can be used to reduce the voltage with which the circuit is supplied in the standby state and hence also to reduce said circuit's power consumption.

When changing from the first state to the second state the first controllable switch is actuated via a regulating circuit such that the voltage for operating the circuit changes linearly with time. The regulating circuit allows the voltage change and hence also the current which is used to charge the circuit's capacitance to be regulated.

The regulating circuit is deactivated in the first state. In the first state, which is a standby state, deactivating the regulating circuit reduces power consumption.

In the second state the circuit is supplied via the first controllable switch and a second controllable switch. In the second state, which is the normal mode, a second controllable switch is additionally connected in parallel with the first controllable switch in order to reduce the voltage drop across the latter. The first controllable switch is no longer connected as a diode in the second state.

The second controllable switch is actuated via a voltage monitoring unit, a first input of the voltage monitoring unit being connected to the output of the regulating circuit. At the output of the regulating circuit, it is possible to establish whether the voltage for operating the circuit has risen linearly far enough in order to be able to change to normal mode. This is done using the voltage monitoring unit, which activates the second controllable switch.

In the on-state mode the second controllable switch has a lower resistance than the first controllable switch. The first controllable switch is used primarily in order to lower the supply voltage for the circuit arrangement, while the second controllable switch is used to supply the circuit with a minimum voltage drop in normal mode.

The voltage monitoring unit is deactivated in the first state. Deactivating the voltage monitoring unit allows the circuit arrangement's power requirement in standby mode to be reduced further.

FIG. 1 shows an exemplary embodiment of the inventive circuit arrangement with a first supply voltage connection V1, to which a supply voltage VDD is applied. A circuit S, which is represented by a capacitance CS and other elements SB, has a first supply connection A1 to which a voltage VS for operating the circuit S can be applied. The circuit S is connected to the second supply voltage connection V2 of the circuit arrangement, which is at a ground potential, via a second supply connection, which is not explicitly labeled. The circuit S is intended to be operated at a first voltage in a first state, which is a standby or quiescent state, and to be supplied with a second voltage in a second state, which is a normal mode. The first voltage is lower than the second voltage. To avoid voltage dips at the supply voltage VDD for the circuit arrangement and undesirably large charging currents, the voltage VS for operating the circuit S must not change abruptly when changing over from the standby state to normal mode. The changeover apparatus U required for this comprises all the elements in FIG. 1 apart from the circuit S.

The circuit S is connected to the first supply voltage connection V1 via the parallel-connected first controllable switch T1 and second controllable switch T2. The first and second controllable switches T1 and T2 each have a first connection E1, E2, a second connection F1, F2 and a control input G1, G2. In this exemplary embodiment, the controllable switches T1 and T2 are designed as PMOS transistors. It goes without saying that it is possible for a person skilled in the art to modify the circuit arrangement such that NMOS transistors can be used, which means that the circuit is able to raise the negative supply voltage VSS for the circuit S. The transistor T1 has a smaller width than the transistor T2, which is flagged by the thicker bar in the transistor T2.

In standby mode, the first and second switches S1 and S2 are open, which means that the operational amplifier O and the voltage monitoring unit C are off. The third switch S3 is closed and connects the two inputs O1, O2 of the operational amplifier O to one another so that the initial conditions are stipulated when the operational amplifier O is turned on. The fourth switch S4 is closed, which means that the second connection F1 of the first transistor T1 is connected to the latter's control input G1. The transistor T1 is therefore connected as a diode. Since the transistor T1 is connected as a diode, it has the diode threshold voltage VTH dropping across it, which means that the voltage VS for operating the circuit is lowered to VS=VDD−VTH in the standby state. On account of the lower voltage, a lower power consumption for the circuit arrangement is thus obtained. The fifth switch S5 is closed, which means that the control input G2 of the second transistor T2 is connected to the first supply voltage connection V1 of the circuit arrangement. Consequently, the second transistor T2 is off and current can flow only via the first controllable switch T1.

Figure 2:
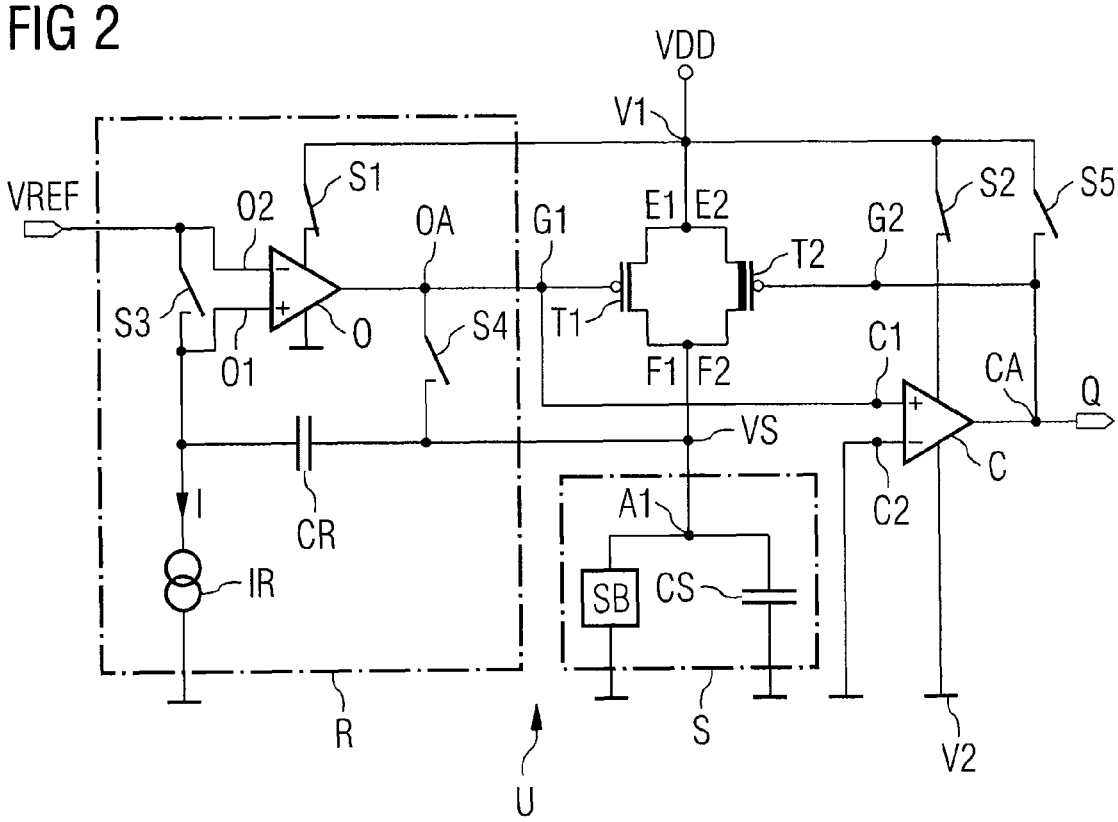
FIG. 2 shows an exemplary embodiment of the inventive circuit arrangement in a second state.

When changing over from the standby state to the normal-mode state, all five switches S1 to S5 are changed over. FIG. 2 shows the positions of the switches during the change from the standby state to the normal-mode state. The first switch S1 and the second switch S2 are now closed, which means that the operational amplifier O in the regulating circuit R and the voltage monitoring unit C are activated. The third switch S3 is open, which means that the operational amplifier O attempts to set the voltage at its output OA such that the voltage at its first input O1 matches the voltage at its second input O2. The second input of the operational amplifier O2 has a reference voltage VREF applied to it, which means that the voltage VREF is likewise applied to the first input O1 of the operational amplifier, and hence also the current source IR in the regulating circuit R is activated. The reference voltage VREF is chosen such that the operational amplifier O can operate in a favorable common-mode range and may be 0.4 V, for example.

Since no current flows into the inputs O1, O2 of the operational amplifier O, the current I from the current source IR must flow through the capacitor CR in the regulating circuit. In accordance with the capacitor's fundamental equation, a current flowing through the capacitor is proportional to the change in the voltage applied to the capacitor over time. With a constant current I, the voltage across the capacitor CR therefore increases linearly. Since one end of the capacitor CR is connected to the first input O1 of the operational amplifier O and is thus permanently at the reference potential VREF, the voltage VS for operating the circuit S needs to change linearly over time. This is achieved by virtue of the operational amplifier O outputting a voltage at its output OA which actuates the control input G1 of the first transistor T1 such that the potential VS changes accordingly. To this end, the voltage applied to the control input G1 needs to become ever lower so that the transistor T1 is on more and more. In this case, the fourth switch S4 is open, which means that the first transistor T1 together with the operational amplifier O, the current source IR and the capacitor CR in the regulating circuit can be used to regulate the voltage VS for operating the circuit S.

When the voltage on the control input G1 reaches its lowest value, this is detected in the voltage monitoring unit C, since the latter's first input C1 is connected to the control input G1 and its second input is connected to the second supply voltage connection V2 of the circuit arrangement. The voltage monitoring unit C is in the form of a comparator which has a small offset, which means that the comparator changes over when the voltage on the control input G1 is almost equal to the voltage on the second supply voltage connection V2. At this instant, the voltage VS for operating the circuit S has already almost risen to the supply voltage VDD, which means that the charging operation for the circuit's capacitance CS is almost complete. The output CA of the voltage monitoring unit C now produces a Low signal which, since the fifth switch S5 is open, pulls the control input G2 of the second transistor T2 to a Low potential. The second transistor T2 is thus on and the status signal Q indicates that the circuit S is now being supplied with the full supply voltage VDD, the standby state can be exited and the normal mode can be started. In this case, the second transistor T2 has a lower on-state resistance than the first transistor T1 in order to reduce on-state losses on account of its greater width.

When changing over all the switches S1 to S5 returns to the standby state, the voltage VS for operating the circuit S falls slowly, since the leakage current from the circuit S is at first delivered from the capacitance in the circuit CS. Only when VS has fallen so far that the voltage on the transistor T1 connected as a diode is sufficient to deliver precisely this leakage current is a balance achieved again and VS remains at the lowered potential VS=VDD−VTH.

Figure 3:
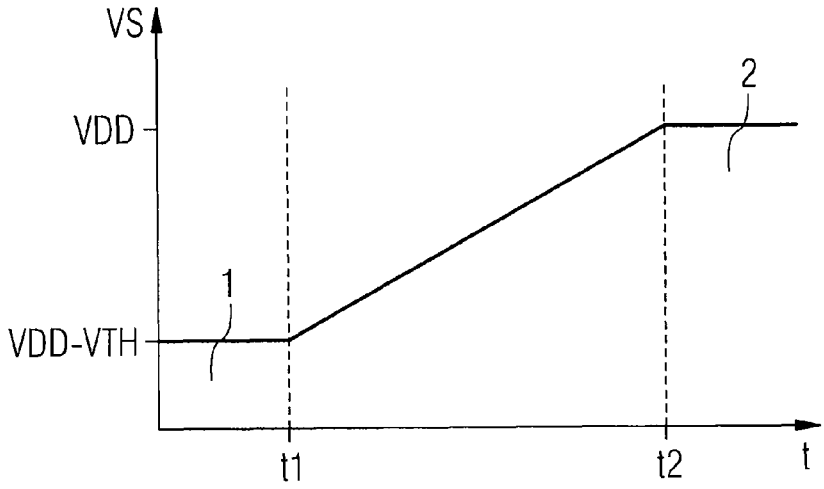
FIG. 3 shows a time profile for the voltage for operating the circuit when changing over from a first state to a second state.

FIG. 3 shows the profile of the voltage VS for operating the circuit S over time t. Before the instant t1, the circuit arrangement is in the first state, that is to say the standby state, in which VS=VDD−VTH is true. At instant t1, the switches S1 to S5 are changed over and the voltage VS rises linearly. Between the instants t1 and t2, the capacitance in the circuit CS is charged. The rise here turns out to be VS(t)=I/CR*(t−t1)+VDD−VTH. The rise in the voltage VS is thus independent of the capacitance CS in the circuit S, the further components SB in the circuit S and also of the reference voltage VREF. The rise can be set via the current I from the current source IR and the capacitance of the capacitor CR in the regulating circuit. At instant t2, the voltage VS has reached the supply voltage VDD. Using the above formula, the instant t2 is calculated as t2=t1+VTH*CR/I. After the instant t2, the circuit arrangement is in the second state, that is to say the normal-mode state.

The linear rise in the voltage VS for operating the circuit S means that the current for charging the capacitance CS in the circuit S is constant. The inventive circuit arrangement and the method for operating this arrangement mean that the capacitance CS in the circuit S is thus charged in adjustable and controlled fashion by means of the current I, which means that there is neither a voltage dip in the supply voltage VDD nor an undesirably large charging current.

What is claimed is:

1. A circuit arrangement, comprising:

a changeover apparatus providing a first voltage for operating a circuit in a first state and a second voltage for operating the circuit in a second state, the changeover apparatus comprising a first controllable switch and a second controllable switch connected in parallel between a first connection and a second connection, wherein each of the controllable switches has a control input, the first connection is connected to a first supply voltage connection of the circuit arrangement, and the second connection is connected to a first supply connection of the circuit which is to be operated, wherein a voltage change between the first voltage in the first state and the second voltage in the second state is linear with time.

2. The circuit arrangement of claim 1, wherein each of the first controllable switch and the second controllable switch is a transistor.

3. The circuit arrangement of claim 2, wherein the control input of the first controllable switch can be connected via a fourth switch to the first supply connection of the circuit which is to be operated.

4. The circuit arrangement of claim 3, wherein the changeover apparatus comprises a regulating circuit for actuating the first controllable switch.

5. The circuit arrangement of claim 4, wherein the regulating circuit comprises:

an operational amplifier having a first input, a second input and an output, the output of the operational amplifier being connected to the control input of the first controllable switch;

a capacitor which is connected between the first input of the operational amplifier and the first supply connection of the circuit which is to be operated;

a current source which is connected to the first input of the operational amplifier and to a second supply voltage connection of the circuit arrangement; and a reference voltage which is connected to the second input of the operational amplifier.

6. The circuit arrangement of claim 5, wherein the operational amplifier can be connected via a first switch to the first supply voltage connection of the circuit arrangement.

7. The circuit arrangement of claim 5, wherein the first input and the second input of the operational amplifier can be connected via a third switch.

8. The circuit arrangement of claim 1, wherein the changeover apparatus comprises a voltage monitoring unit for actuating the second controllable switch, the voltage monitoring unit having a first input, a second input and an output.

9. The circuit arrangement of claim 8, wherein the first input of the voltage monitoring unit is connected to the control input of the first controllable switch, the second input of the voltage monitoring unit is connected to the second supply voltage connection of the circuit arrangement, and the output of the voltage monitoring unit is connected to the control input of the second controllable switch.

10. The circuit arrangement of claim 8, wherein the voltage monitoring unit can be connected via a second switch to the first supply voltage connection of the circuit arrangement.

11. The circuit arrangement of claim 1, wherein the control input of the second controllable switch can be connected via a fifth switch to the first supply voltage connection of the circuit arrangement.

12. The circuit arrangement of claim 1, further comprising an operational amplifier having a first input, a second input and an output, wherein the output of the operational amplifier is connected to the control input of the first controllable switch, and operational amplifier can be connected via a first switch to the first supply voltage connection of the circuit arrangement, and the first input and the second input of the operational amplifier can be connected via a third switch, wherein the changeover apparatus comprises a voltage monitoring unit for actuating the second controllable switch, the voltage monitoring unit having a first input, a second input and an output, wherein the voltage monitoring unit can be connected via a second switch to the first supply voltage connection of the circuit arrangement, wherein the control input of the first controllable switch can be connected via a fourth switch to the first supply connection of the circuit which is to be operated, wherein the control input of the second controllable switch can be connected via a fifth switch to the first supply voltage connection of the circuit arrangement, and wherein in the first state the first and second switches are closed and the third, fourth and fifth switches are open, and in the second state the first and second switches are open and the third, fourth and fifth switches are closed.

13. A method for operating a circuit in a first state during which the circuit is supplied with a first voltage and in a second state during which the circuit is supplied with a second voltage, wherein a voltage change between the first voltage and the second voltage is linear with time, wherein the first state is a standby state.

14. The method of claim 13, wherein the second state is a normal-mode state.

15. The method of claim 14, wherein in the first state the circuit is supplied via a first controllable switch.

16. The method of claim 15, wherein the first controllable switch is a transistor.

17. The method of claim 16, wherein the transistor is connected as a diode in the first state.

18. The method of claim 16, wherein when changing from the first state to the second state the first controllable switch is actuated via a regulating circuit such that the voltage for operating the circuit changes linearly with time.

19. The method of claim 18, wherein the regulating circuit is deactivated in the first state.

20. A method for operating a circuit in a first state during which the circuit is supplied with a first voltage and in a second state during which the circuit is supplied with a second voltage, wherein a voltage change between the first voltage and the second voltage is linear with time, wherein in the second state the circuit is supplied via the first controllable switch and a second controllable switch.

21. The method of claim 20, wherein the second controllable switch is actuated via a voltage monitoring unit, with a first input of the voltage monitoring unit being connected to the output of the regulating circuit.

22. The method of claim 20, wherein in the on-state mode the second controllable switch has a lower resistance than the first controllable switch.

23. The method of claim 21, wherein the voltage monitoring unit is deactivated in the first state.

* * * * *